US008979484B2

(12) United States Patent
Eleftheriou et al.

(10) Patent No.: US 8,979,484 B2
(45) Date of Patent: Mar. 17, 2015

(54) CASING FOR AN AIRCRAFT TURBOFAN BYPASS ENGINE

(75) Inventors: Andreas Eleftheriou, Woodbridge (CA); David Menheere, Georgetown (CA); David Denis, Burlington (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 610 days.

(21) Appl. No.: 13/344,057

(22) Filed: Jan. 5, 2012

(65) Prior Publication Data

US 2013/0177410 A1 Jul. 11, 2013

(51) Int. Cl.
*F01D 25/24* (2006.01)
*F01D 9/06* (2006.01)

(52) U.S. Cl.
CPC ..... *F01D 9/065* (2013.01); *F05D 2230/232* (2013.01)
USPC ..... 415/144

(58) Field of Classification Search
CPC ..... F01D 9/065; F01D 25/24; F05D 2240/10; F05D 2240/128
USPC ..... 415/144, 183, 189, 190, 208.2, 208.3, 415/208.5
See application file for complete search history.

(56) References Cited

U.S. PATENT DOCUMENTS

| | | | |
|---|---|---|---|
| 3,166,903 | A | 1/1965 | White |
| 3,403,889 | A | 10/1968 | Ciokajlo |
| 3,830,058 | A | 8/1974 | Ainsworth |
| 4,369,016 | A | 1/1983 | Dennison |
| 4,502,276 | A | 3/1985 | Pask |
| 4,598,600 | A | 7/1986 | Knowles |
| 4,859,143 | A | 8/1989 | Larrabee et al. |
| 5,115,642 | A | 5/1992 | Cvelbar et al. |
| 5,180,282 | A | 1/1993 | Lenhart et al. |
| 5,292,227 | A | 3/1994 | Czachor et al. |
| 5,361,580 | A | 11/1994 | Ciokajlo et al. |
| 5,483,792 | A | 1/1996 | Czachor et al. |
| 5,871,177 | A | 2/1999 | Demouzon et al. |
| 6,619,030 | B1 | 9/2003 | Seda et al. |
| 6,672,833 | B2 | 1/2004 | MacLean et al. |
| 6,708,482 | B2 | 3/2004 | Seda |
| 6,860,716 | B2 | 3/2005 | Czachor et al. |
| 6,883,303 | B1 | 4/2005 | Seda |
| 7,097,413 | B2 | 8/2006 | VanDuyn |
| 7,100,358 | B2 | 9/2006 | Gekht et al. |
| 7,266,941 | B2 | 9/2007 | Eleftheriou et al. |
| 7,370,467 | B2 | 5/2008 | Eleftheriou et al. |
| 7,565,796 | B2 | 7/2009 | Eleftheriou et al. |
| 7,594,404 | B2 | 9/2009 | Somanath et al. |

(Continued)

FOREIGN PATENT DOCUMENTS

| | | |
|---|---|---|
| EP | 2444645 | 4/2012 |

*Primary Examiner* — Nathaniel Wiehe
*Assistant Examiner* — Brian O Peters
(74) *Attorney, Agent, or Firm* — Norton Rose Fulbright Canada LLP

(57) ABSTRACT

A casing for an aircraft turbofan bypass engine includes an outer ring, an inner hub and a plurality of struts radially extending therebetween. An annular portion of an engine core casing having an outer wall and an inner wall, is disposed between the outer ring and inner hub, forming an annular splitter supporting an upstream splitter tip structure. The annular splitter further includes an intermediate wall disposed in the annular splitter fixed to the outer wall and the struts, to distribute loads from the annular splitter box to the struts.

13 Claims, 3 Drawing Sheets

(56) References Cited

U.S. PATENT DOCUMENTS

| | | | | |
|---|---|---|---|---|
| 7,594,405 | B2 | 9/2009 | Somanath et al. | |
| 7,762,087 | B2 | 7/2010 | Somanath et al. | |
| 7,765,787 | B2 | 8/2010 | Eleftheriou et al. | |
| 7,775,049 | B2 | 8/2010 | Kumar et al. | |
| 7,793,488 | B2 | 9/2010 | Eleftheriou et al. | |
| 7,797,922 | B2 | 9/2010 | Eleftheriou et al. | |
| 7,797,946 | B2 | 9/2010 | Kumar et al. | |
| 7,802,962 | B2 | 9/2010 | Sjoqvist | |
| 7,950,236 | B2 | 5/2011 | Durocher et al. | |
| 8,038,386 | B2 | 10/2011 | Duchatelle et al. | |
| 8,057,170 | B2 | 11/2011 | Latham | |
| 8,061,969 | B2 | 11/2011 | Durocher et al. | |
| 8,091,371 | B2 | 1/2012 | Durocher et al. | |
| 8,113,768 | B2 | 2/2012 | Somanath et al. | |
| 8,157,530 | B2 | 4/2012 | Krutzfeldt et al. | |
| 2005/0022501 | A1* | 2/2005 | Eleftheriou et al. | 60/226.1 |
| 2007/0231134 | A1 | 10/2007 | Kumar et al. | |
| 2007/0237635 | A1 | 10/2007 | Nagendra et al. | |
| 2007/0261411 | A1 | 11/2007 | Nagendra et al. | |
| 2008/0134688 | A1 | 6/2008 | Somanath et al. | |
| 2010/0132369 | A1 | 6/2010 | Durocher et al. | |
| 2010/0132371 | A1 | 6/2010 | Durocher et al. | |
| 2010/0132372 | A1 | 6/2010 | Durocher et al. | |
| 2010/0135770 | A1 | 6/2010 | Durocher et al. | |
| 2011/0173990 | A1 | 7/2011 | Thies | |
| 2012/0195753 | A1 | 8/2012 | Davis et al. | |

* cited by examiner

CASING FOR AN AIRCRAFT TURBOFAN BYPASS ENGINE

TECHNICAL FIELD

The described subject matter relates generally to turbofan gas turbine engines, and more particularly to an intermediate case of a turbofan gas turbine engine.

BACKGROUND OF THE ART

Aircraft turbofan engines typically have a segmented case assembly including, for example a fan case, an intermediate case, a compressor case, a gas generator case, a turbine case and a turbine exhaust case, all positioned about an engine central axis. A splitter structure may extend forwardly of struts in the intermediate case. The intermediate case is conventionally cast with struts and the splitter structure integrally cast therein. However, casting is a process which is difficult to control and which requires minimum weight thicknesses to achieve acceptable quality because the structure not only performs aerodynamic functions but must also bear thrust loads. There is also a need for using interior spaces of a splitter and strut structures for services for air/oil systems, instrumentation and maintenance activities such as borescope inspections.

Accordingly, there is a need to provide an improved intermediate case of an aircraft turbofan engine.

SUMMARY

In one aspect, the described subject matter provides a casing for an aircraft turbofan bypass engine comprising: an outer ring and an inner hub defining an annular space therebetween, the inner hub configured for connection to at least one spool bearing, the outer ring configured for connection to at least one engine mount; a plurality of hollow radial struts arranged in a circumferential array mounting the inner hub to the outer ring; and an annular splitter box disposed between the inner hub and outer ring and configured to be connected with an upstream annular splitter tip structure to divide an air flow through the annular space into a core air flow and a bypass air flow, the splitter box defined by an inner wall and an outer wall, the splitter box further having an intermediate wall extending downstream conically inward from said outer wall, the splitter box having openings in each of said inner, outer and intermediate walls for receiving said struts passing therethrough, each of said splitter box walls terminating at a downstream end configured for connection to a downstream engine case, the struts being mounted to said splitter box with a respective peripheral weld or braze between the intermediate wall and the struts at the openings of the intermediate wall.

In another aspect, the described subject matter provides an aircraft turbofan bypass engine comprising: a fan assembly, a compressor assembly, a combustion gas generator assembly and a turbine assembly; and a fabricated case having an annular splitter box supporting an upstream annular splitter tip structure, the annular splitter tip structure dividing a fan driven inlet air flow into a bypass air flow and a core air flow, the fabricated case including: an outer ring and an inner hub defining an annular space therebetween, the inner hub configured for connection with at least one spool bearing, the outer ring configured for connection with at least one engine mount; a plurality of load-bearing hollow radial struts arranged in a circumferential array to mount the inner hub to the outer ring, an annular splitter box disposed within the annular space and including an annular outer wall and an annular inner wall, the annular inner wall being disposed within the annular outer wall, the annular splitter box being connected to the upstream annular splitter tip structure and a downstream engine case, the annular outer wall in combination with the outer ring defining a section of a bypass air duct for directing said bypass air flow, the annular inner wall in combination with the inner hub defining a section of a core fluid path of the engine for directing said core air flow, the annular outer and annular inner walls defining a plurality of respective circumferentially spaced openings for allowing the individual struts to radially extend therethrough, and an annular intermediate wall extending downstream conically inward from the outer wall and connected to the downstream engine case, the intermediate wall having a plurality of circumferentially spaced openings receiving the individual struts to radially extend therethrough, the annular intermediate wall being affixed to the struts by welding or brazing along a periphery of a respective one of said openings in the annular immediate wall, an upstream end of the annular intermediate wall being welded or brazed to the annular outer wall and a downstream end of the annular intermediate wall being welded or brazed to a plurality of circumferentially spaced brackets, each bracket being welded or brazed to a corresponding one of the respective struts.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

DETAILED DESCRIPTION

Figure 1:
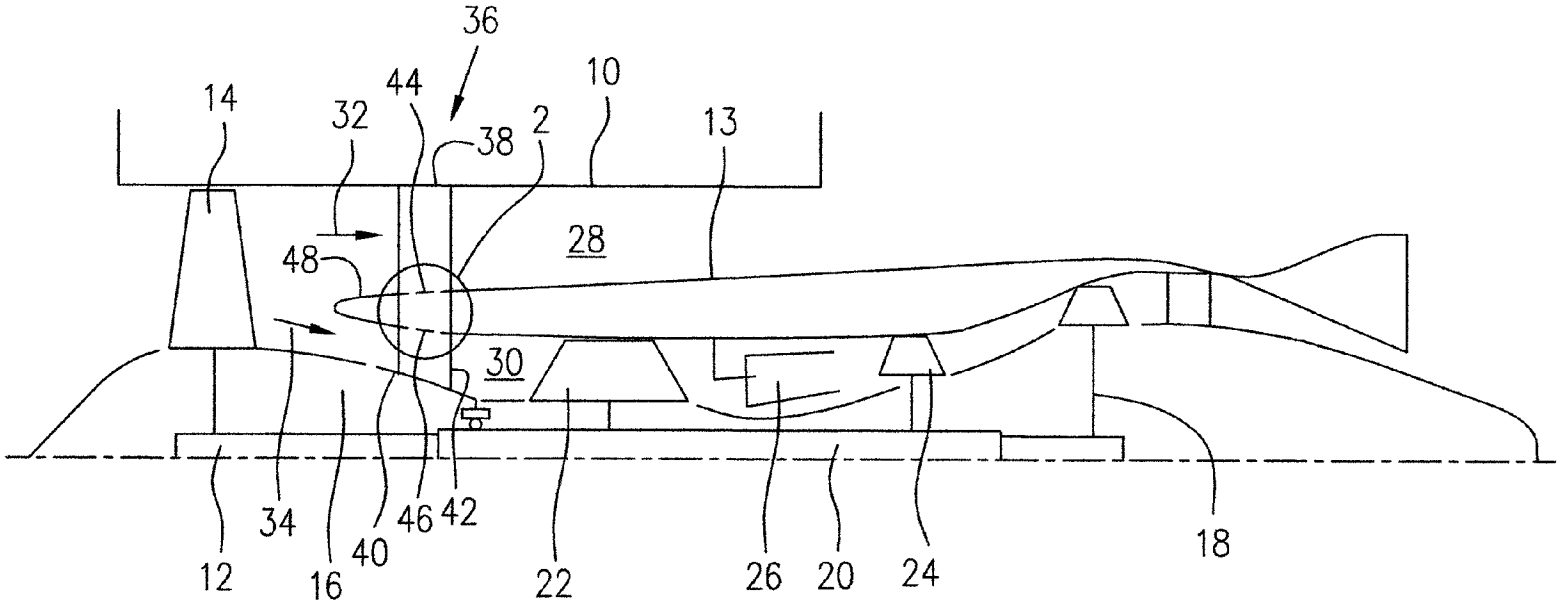
FIG. 1 is a schematic partial cross-sectional view of a turbofan bypass gas turbine engine as an exemplary application of the described subject matter.

Referring to FIG. 1, a turbofan bypass gas turbine engine includes a housing or nacelle 10, a core casing 13, a low pressure spool assembly (not numbered) which includes a fan assembly 14, a low pressure compressor assembly 16 and a low pressure turbine assembly 18 connected by a shaft 12, and a high pressure spool assembly (not numbered) which includes a high pressure compressor assembly 22 and a high pressure turbine assembly 24 connected by a turbine shaft 20. The housing or nacelle 10 surrounds the core casing 13 and in combination the housing 10 and core casing 13 define an annular bypass air duct 28 for directing a bypass air flow (indicated by arrows 32) which is driven by the fan assembly 14, to be discharged, thereby providing thrust to the engine. The core casing 13 surrounds the low and high pressure spool assemblies to define a core fluid path 30 therethrough. In the core fluid path 30 there is provided a combustor 26 to form a combustion gas generator assembly which generates combustion gases to power the high pressure turbine assembly 24 and the low pressure turbine assembly 18. A core air flow (indicated by arrow 34) driven by the fan assembly 14, is directed through the core fluid path 30 to the combustor 26 for combustion.

The terms "axial", "radial" and "circumferential" used for various components below are defined with respect to the main engine axis shown but not numbered in FIG. 1. The terms "upstream" and "downstream" mentioned in the description below generally refer to the air flow direction indicated such as by arrows 32 and 34.

Figure 2:
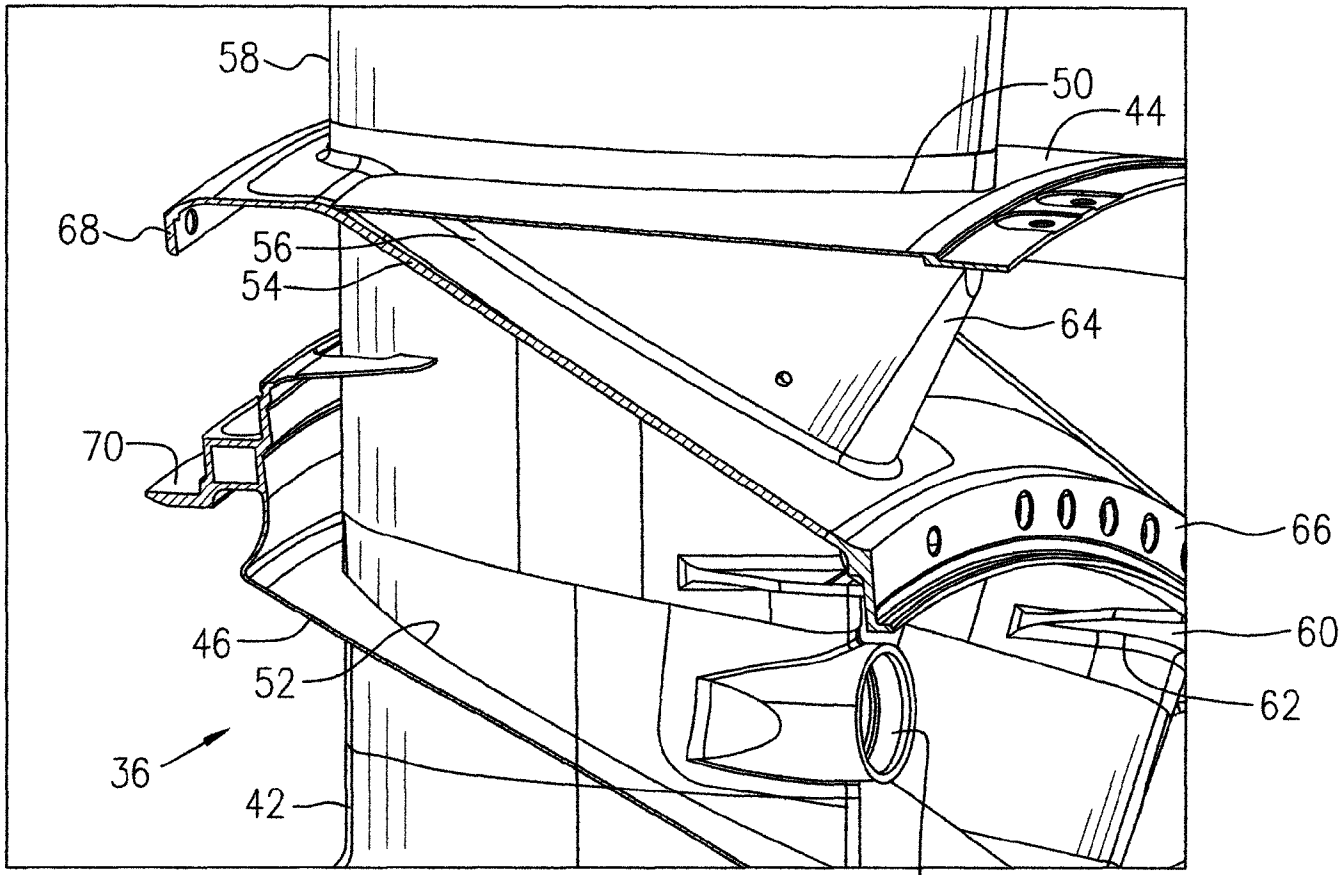
FIG. 2 is a partial perspective view of an annular splitter box structure of an intermediate case, as shown in a circled area 2 in FIG. 1, with a front portion cut away to show the inside of the annular splitter box structure.
Figure 3:
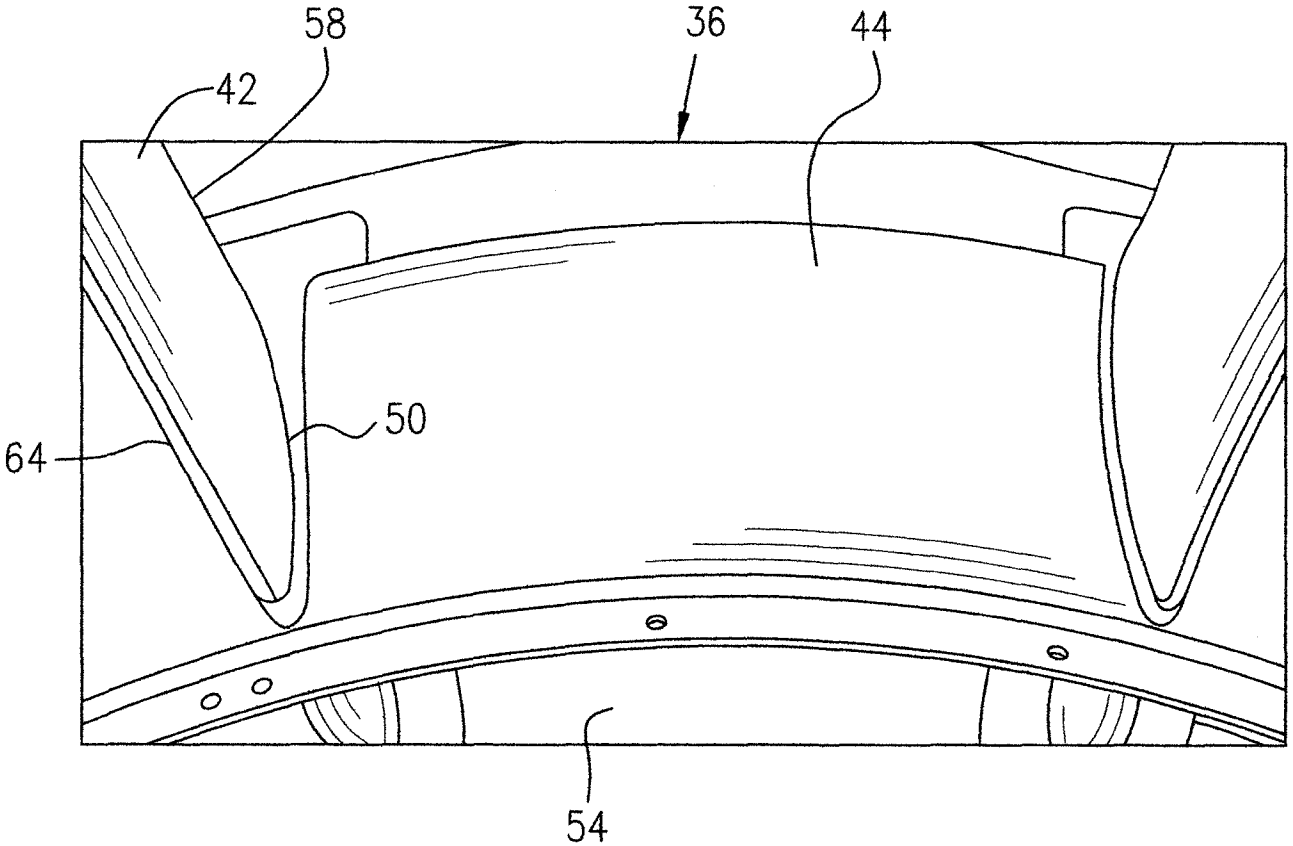
FIG. 3 is a partial rear perspective view of the annular splitter box structure of FIG. 2.

Referring to FIGS. 1-3, a fabricated intermediate case 36 includes an outer ring 38 which is a portion of the housing or nacelle 10 of the engine and is configured for connection with at least one engine mount, and an inner hub 40, in combination defining an annular space (not numbered) radially therebetween. The inner hub 40 may be connected to one or more bearing assemblies (not numbered) to support either one or both shafts 12 and 20. A plurality of load-bearing hollow struts 42 are arranged in a circumferential array and extend from the inner hub 40 radially outwardly to the outer ring 38, thereby mounting the inner hub 40 to the outer ring 38. As used herein, the term "fabricated" indicates that the case is made from individually formed sheet metal and other components and then joined together to provide a fabricated assembly, rather than integrally cast as a complete unit as in typical prior art engine cases.

An annular portion of the engine core casing 13, as shown in the circled area 2 in FIG. 1, is disposed within the annular space between the outer ring 38 and the inner hub 40 and includes an annular outer wall portion 44 and an annular inner wall portion 46 of the engine core casing 13. The annular inner wall portion 46 is disposed within the annular outer wall portion 44. The annular portion of the engine core casing 13 formed with the annular outer wall portion 44 and the annular inner wall portion 46 is connected to an annular splitter tip structure 48 located upstream of the annular portion in the circled area 2 (of FIG. 1), of the engine core casing 13. The annular splitter tip structure 48 forms an annular upstream edge of the core casing 13, to divide the fan driven air flow into the bypass air flow 32 and the core air flow 34. Therefore, the annular outer wall portion 44 and annular inner wall portion 46 in combination form an annular splitter box (not numbered) which supports the annular splitter tip structure 48 to bear loads during engine operation.

The annular outer wall portion 44 which is a connected section of an inner annular boundary of the bypass air duct 28 and the annular inner wall portion 46 which is a connected section of an annular outer boundary of the core fluid path 30, define a plurality of circumferentially spaced openings 50, 52, respectively, for allowing the individual struts 42 to radially extend therethrough. Welding or brazing may be applied along the periphery of the respective openings 50, 52 to connect the struts 42 to the respective annular outer and inner wall portions 44, 46.

According to this embodiment, an annular intermediate wall 54 may be provided between the annular outer and inner wall portions 44, 46. A plurality of circumferentially spaced openings 56 may also be defined in the annular intermediate wall 54 for allowing the individual struts 42 to radially extend therethrough. The annular intermediate wall 54 may be affixed to the struts 42 for example by welding or brazing along a periphery of the respective one of the openings 56.

According to this embodiment, an upstream end (not numbered) of the annular intermediate wall 54 may be connected to the annular outer wall portion 44, for example by being welded or brazed to the annular outer wall portion 44 at an axial location adjacent to leading edges 58 of the respective struts 42. The annular intermediate wall 54 may extend from an upstream end (not numbered) to a downstream end (not numbered) thereof axially, inwardly away from the annular outer wall portion 44 and therefore the downstream end of the annular intermediate wall 54 may be radially spaced apart from both the annular outer and inner wall portions 44, 46, thereby providing convenient access to the annular space between the annular outer and inner wall portions 44, 46.

According to this embodiment, a plurality of circumferentially spaced brackets 60 may be provided, each connecting the annular intermediate wall 54 to a corresponding one of the respective struts 42. Each of the brackets 60 may be formed with a plate (not numbered) having a substantially U-shaped slot 62 to receive a trailing edge portion 64 of the corresponding strut 42. The brackets 62 may be affixed to the corresponding strut 42 by welding or brazing along an edge of the slot 62. The annular intermediate wall 54 may further include an annular flange 66 extending radially inwardly from the downstream end of the annular intermediate wall 54. The respective brackets 62 may be connected to the downstream end of the annular intermediate wall 54 by being welded directly to the annular flange 66.

The upstream end of the respective annular outer and inner wall portions 44, 46 may be provided with connecting features, such as annular flanges 68, 70 for connection with the upstream annular splitter tip structure 48. The downstream end of the respective annular outer and inner wall portions 44, 46 (the downstream end of the annular inner wall portion 46 is only schematically shown in FIG. 1 but is not numbered) and the annular flange 66 at the downstream end of the annular intermediate wall 54, may also be provided with mounting features, such as mounting holes, such that the annular splitter box structure as shown in the circled area 2 (see FIG. 1) can be mounted to other components in a downstream section of the annular core casing 13 of the engine.

The annular intermediate wall 54 may have a web (not numbered) which is thicker than the annular skin of the respective annular outer and inner wall portions 44, 46. The annular intermediate wall 54 extends substantially in the axial direction and is integrated by welding or brazing to the annular outer wall portion 44 and all struts 42. Therefore, the annular intermediate wall 54 functions as a single stringer within the annular splitter box, shown in the circled area 2 in FIG. 1, to evenly distribute torque and axial loads applied to the annular splitter box tip structure 48 and the splitter box during engine operation, to all the struts 42. The struts 42 then transfer the torque and axial loads to an engine mount (not shown) through the outer ring 38. The optional brackets 60 integrated by welding or brazing to both the annular intermediate wall 54 and respective struts 42, may function as tertiary braces to enhance integration of the annular intermediate wall 54 with all the struts 42, thereby helping to even distribution of loads from the splitter box to all the struts 42.

The substantially axial orientation of the annular intermediate wall 54 with the downstream end thereof radially spaced apart from both annular outer and inner wall portions 44, 46, provides axial access to the annular space defined between the annular outer and inner wall portions 44, 46. This axial access makes it convenient to provide services within the annular splitter box for air/oil systems, instrumentation and maintenance activities of the engine. For example, a service port 72 may be provided on the trailing edge portion 64 of one hollow strut 42 which may allow air/oil service lines to be inserted into the hollow strut 42 or may allow borescope inspection therethrough.

The above description is meant to be exemplary only, and one skilled in the art will recognize that changes may be made to the embodiments described without departure from the scope of the described subject matter. For example, the turbofan gas turbine engine as illustrated, is an example taken to illustrate the application of the described subject matter and does not limit the various features and structures of the engines to which the described subject matter may be applicable. Furthermore, the intermediate case may include various other components which are not described. Still other modifications which fall within the scope of the described subject matter will be apparent to those skilled in the art, in light of a review of this disclosure, and such modifications are intended to fall within the appended claims.

The invention claimed is:

1. A casing for an aircraft turbofan bypass engine comprising:

an outer ring and an inner hub defining an annular space therebetween, the inner hub configured for connection to at least one spool bearing, the outer ring configured for connection to at least one engine mount;

a plurality of hollow radial struts arranged in a circumferential array mounting the inner hub to the outer ring; and an annular splitter box disposed between the inner hub and outer ring and configured to be connected with an upstream annular splitter tip structure to divide an air flow through the annular space into a core air flow and a bypass air flow, the splitter box defined by an inner wall and an outer wall, the outer ring and the outer wall of the splitter box in combination forming a bypass duct for the bypass air flow, the inner wall of the splitter box and the inner hub in combination forming a core fluid path for the core air flow, the splitter box further having an intermediate wall positioned radially between the inner and outer walls and extending downstream conically inward from said outer wall, the splitter box having openings in each of said inner, outer and intermediate walls for receiving said struts passing therethrough, each of said splitter box walls terminating at a downstream end configured for connection to a downstream engine case, the struts being mounted to said splitter box with a respective peripheral weld or braze between the intermediate wall and the struts at the openings of the intermediate wall.

2. The casing as defined in claim 1 wherein the annular intermediate wall is thicker than the respective annular outer and inner walls.

3. The casing as defined in claim 1 wherein the downstream end of the annular intermediate wall is radially spaced apart from both annular outer and inner walls to provide access to the annular space between the annular outer and inner walls.

4. The casing as defined in claim 1 wherein an upstream end of the annular intermediate wall is welded or brazed to the annular outer wall at an axial location adjacent leading edges of the struts.

5. The casing as defined in claim 1 wherein the annular splitter box comprises a plurality of circumferentially spaced brackets, each connecting the annular intermediate wall to a corresponding one of the respective struts.

6. The casing as defined in claim 5 wherein each of the brackets comprises a plate having a substantially U-shaped slot to receive a trailing edge portion of the corresponding strut, and the bracket being affixed to the corresponding strut by welding or brazing along an edge of the slot.

7. The casing as defined in claim 1 wherein the splitter box comprises a plurality of circumferentially spaced brackets, each bracket connecting a corresponding one of the respective struts to an annular flange extending radially inwardly from a downstream end of the annular intermediate wall.

8. An aircraft turbofan bypass engine comprising:

a fan assembly, a compressor assembly, a combustion gas generator assembly and a turbine assembly; and a fabricated case having an annular splitter box supporting an upstream annular splitter tip structure, the annular splitter tip structure dividing a fan driven inlet air flow into a bypass air flow and a core air flow, the fabricated case including:

an outer ring and an inner hub defining an annular space therebetween, the inner hub configured for connection with at least one spool bearing, the outer ring configured for connection with at least one engine mount;

a plurality of load-bearing hollow radial struts arranged in a circumferential array to mount the inner hub to the outer ring, an annular splitter box disposed within the annular space and including an annular outer wall and an annular inner wall, the annular inner wall being disposed within the annular outer wall, the annular splitter box being connected to the upstream annular splitter tip structure and a downstream engine case, the annular outer wall in combination with the outer ring defining a section of a bypass air duct for directing said bypass air flow, the annular inner wall in combination with the inner hub defining a section of a core fluid path of the engine for directing said core air flow, the annular outer and annular inner walls defining a plurality of respective circumferentially spaced openings for allowing the individual struts to radially extend therethrough, and an annular intermediate wall extending downstream conically inward from the outer wall and connected to the downstream engine case, the intermediate wall having a plurality of circumferentially spaced openings receiving the individual struts to radially extend therethrough, the annular intermediate wall being affixed to the struts by welding or brazing along a periphery of a respective one of said openings in the annular immediate wall, an upstream end of the annular intermediate wall being welded or brazed to the annular outer wall and a downstream end of the annular intermediate wall being welded or brazed to a plurality of circumferentially spaced brackets, each bracket being welded or brazed to a corresponding one of the respective struts.

9. The aircraft turbofan bypass engine as defined in claim 8 wherein each of the brackets comprises a plate having a substantially U-shaped slot to receive a trailing edge portion of the corresponding strut.

10. The aircraft turbofan bypass engine as defined in claim 8 wherein an upstream end of the annular intermediate wall is welded or brazed to the annular outer wall at an axial location adjacent leading edges of the struts.

11. The aircraft turbofan bypass engine as defined in claim 8 wherein the downstream end of the annular intermediate wall is radially spaced apart from the annular outer and inner walls, to provide access to the annular space between the annular outer and inner walls.

12. The aircraft turbofan bypass engine as defined in claim 8 wherein the annular intermediate wall is thicker than the respective annular outer and inner walls.

13. The aircraft turbofan bypass engine as defined in claim 8 wherein the downstream end of the intermediate wall comprises a radially inwardly extending flange for connection with the downstream engine case.

* * * * *